United States Patent [19]

Geraci

[11] Patent Number: 4,979,726

[45] Date of Patent: Dec. 25, 1990

[54] CHAIR HAVING LIFT APPARATUS

[76] Inventor: Alexander Geraci, 5221 N. Lind Ave., Chicago, Ill. 60630

[21] Appl. No.: 523,603

[22] Filed: May 15, 1990

Related U.S. Application Data

[63] Continuation-in-part of Ser. No. 314,164, Feb. 23, 1989, Pat. No. 4,929,022.

[51] Int. Cl.[5] ..... A47C 1/02

[52] U.S. Cl. ..... 297/313; 297/DIG. 10; 297/339

[58] Field of Search ..... 297/183, 338, 339, 337, 297/313, DIG. 10, DIG. 4

[56] References Cited

U.S. PATENT DOCUMENTS

| | | | |
|---|---|---|---|
| 1,288,216 | 12/1918 | Sayles | 297/DIG. 10 |
| 1,698,344 | 1/1929 | Mott | 297/339 |
| 2,539,034 | 1/1951 | Ruby | 297/DIG. 10 |
| 3,640,566 | 2/1972 | Hodge | 297/DIG. 10 |
| 4,690,457 | 9/1987 | Poncy et al. | 297/337 |
| 4,838,612 | 6/1989 | Cross | 297/338 |
| 4,907,303 | 3/1990 | Baird | 297/313 X |
| 4,929,022 | 5/1990 | Geraci | 297/313 |

*Primary Examiner*—Peter A. Aschenbrenner
*Attorney, Agent, or Firm*—Samuel Kurlandsky

[57] ABSTRACT

A chair having lifting means for assisting a physically impaired occupant to arise from the chair, having a frame, a seat hingeadly mounted at its forward edge to the frame, seat lifting means, and spring biasing actuating means arranged to spring-bias the seat to an upward-most position, thereby assisting the occupant of the seat to rise out of the seat.

5 Claims, 1 Drawing Sheet

CHAIR HAVING LIFT APPARATUS

RELATED APPLICATION

The present invention is a continuation-in-part of copending application U.S. Ser. No. 07/314,164, now U.S. Pat. No. 4,929,022, filed Feb. 23, 1989, by the present inventor.

BACKGROUND OF THE INVENTION

1. Field of the Invention

The present invention relates to chairs, and more particularly refers to a chair having a mechanism for assisting a physically impaired person sitting in the chair to lift himself out of the chair.

2. Description of the Prior Art

Several chairs have been disclosed in the prior art having means for assisting occupants who are physically impaired to lift themselves out of the chair. In some of the structures electric motor driven apparatus is utilized to lift the chair occupant. In others hydraulic cylinders are utilized to assist in lifting the occupant. These types of apparatus are all very heavy to move around, require an external power source, and are very expensive to fabricate. Other arrangements have been disclosed which utilize pivotal or tilting seats. However, they have not been entirely satisfactory, and additionally have been prohibitively expensive.

SUMMARY OF THE INVENTION

It is an object of the invention to provide a chair having means to assist a physically impaired occupant to arise out of the chair.

It is a further object of the invention to provide a chair of the type described which is relatively easy to operate by the occupant without help from another individual.

It is still further an object of the invention to provide a chair of the type described which does not require an external power source.

It is an additional object to provide structures of the type described which are relatively simple to construct and which additionally are relatively inexpensive.

The forgoing and other objects, advantages and characterizing features of the invention will become apparent from the following description of certain illustrative embodiments thereof, considered together with the accompanying drawing, wherein like reference numerals signify like elements throughout the various figures.

According to the invention, a chair is provided having lifting means for assisting a physically impaired occupant to get out of the chair, the structure of the invention comprising a frame formed of similar frame members on both sides of the chair and means connecting both sides together, a seat member having its forward edge hinged connected to a portion of the frame, seat raising means arranged for raising the seat and providing a spring-biasing force thereon, spring bias actuating means for providing a spring biasing force on the seat raising means, and means for affixing the spring bias actuating means in spring biasing operating position or alternatively releasing the spring means thereby permitting the seat to return to its lowermost collapsed condition.

DESCRIPTION OF THE PREFERRED EMBODIMENTS

Figure 1:
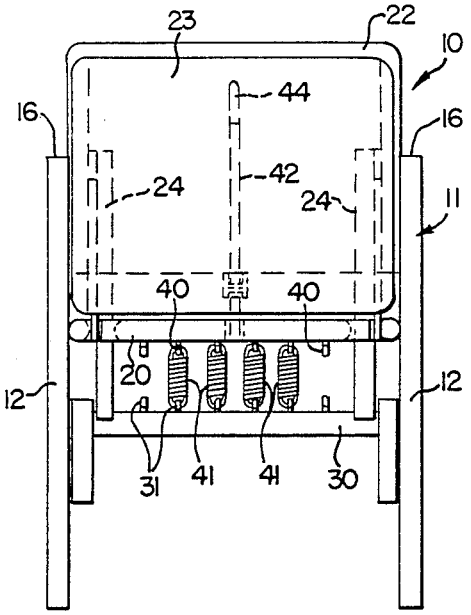
FIG. 1 is a front elevational view of a chair according to the invention showing the seat thereof in the upwardly spring-biased position.
Figure 2:
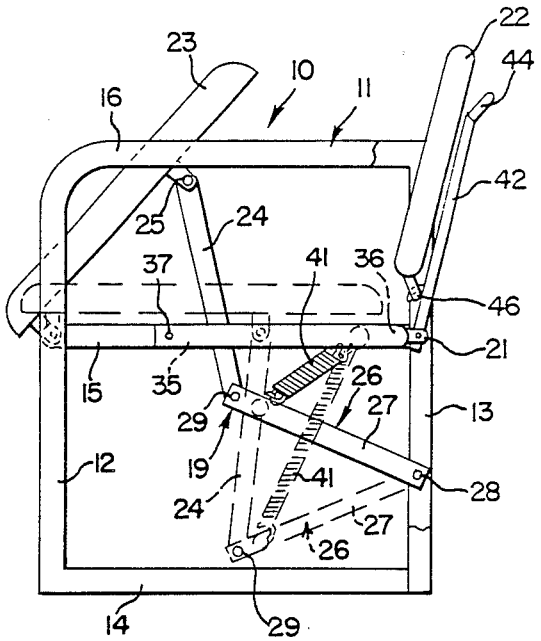
FIG. 2 is a side elevational view of the chair shown in FIG. 1.

Referring to FIGS. 1 and 2, a chair 10 according to the invention is shown, comprising a frame 11 having identical frame members on each of the right and left sides, the frame members on each side comprising a front vertical frame member 12, a rear vertical frame member 13, a lower horizontal frame member 14, an upper horizontal frame member 15, and an arm rest 16. The frame members of the right and left sides are connected together by a front horizontal frame member 20 and a rear horizontal frame member 21. Supported between the frame members and attached to the frame are a back support 22 and a seat 23. The seat 23 is hinged mounted at its forward edge to the front horizontal frame member 20.

A seat lifting assembly 19 is pivotally mounted on the frame 11 comprising a pair of seat lift members 24 each pivotally connected at its upper end to one side of the seat 23 by a pivot assembly 25, and a springoperated lever member assembly 26. The assembly comprises a pair of lateral lever members 27, one on each side, connected by pivot assemblies 28 to the respective rear vertical frame members 13 and by pivot assemblies 29 to the lower ends of the vertical seat lift members 24. The assembly 26 additionally has a transverse member 30 connecting the two lateral lever members 27 together. The transverse member 30 is provided with spring-engaging hooks 31.

A spring actuating lever member assembly 35 comprises lateral members 36, one on each side of the frame 11, connected by pivot assemblies 37 to the upper horizontal frame members 15. The assembly 35 additionally has a lower transverse member 38 and an upper transverse member 39 connecting the two lateral members 36 together. The upper transverse member 39 is provided with spring-engaging hooks 40. A plurality of springs 41 are each connected at one end to the hooks 40 of the upper transverse member 39 and at the other end to the hooks 29 of the transverse member 30. An operating lever 42 is connected at one end by a pivot assembly 43 to the lower transverse member 38, and is provided with a hand grip 44 at the other end. A hook 45 is mounted on the engaging lever 42 and is arranged to engage a detent 46 provided on the back rest 22. Alternatively the detent 46 may be mounted on a different part of the chair, such as on the frame 11.

Figure 3:
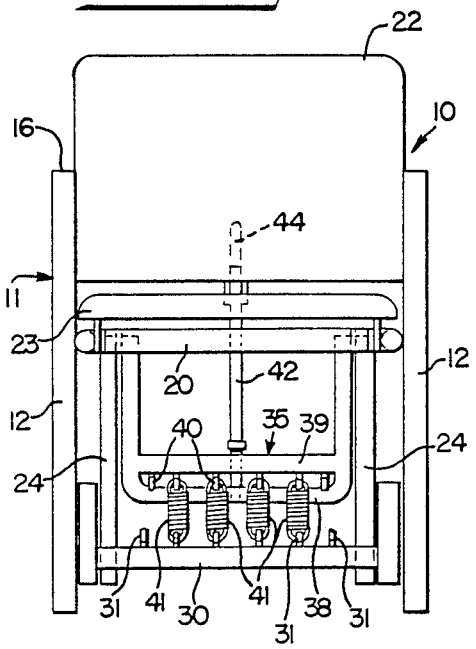
FIG. 3 is a front elevational view of a chair according to the invention with the apparatus in non-spring-biased condition and the seat in its inoperative collapsed condition.
Figure 4:
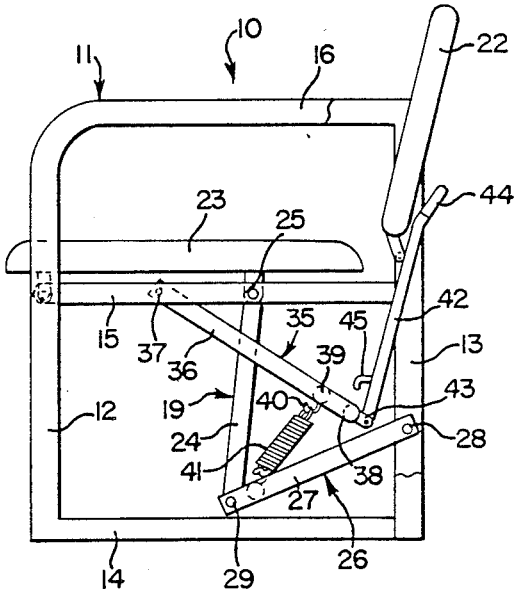
FIG. 4 is a side elevational view of the chair shown in FIG. 3.

The chair of the present invention is shown in the inoperative condition in FIGS. 3 and 4. The hook 45 of the actuating lever 42 is shown in the condition in which it is disengaged from the detent 46. The spring actuating lever member assembly 35 in this condition exerts no force against the lever member assembly 26, and the seat 33 is in the collapsed condition. The chair may be utilized as a normal chair in this condition. To place the chair in operating condition the hand grip 44 is grasped, the lever 42 lifted, and the hook 45 engaged in the detent 46. A spring-biasing force is now exerted against the spring operated lever member assembly causing the seat 23 to be raised into the spring-biased condition shown in FIGS. 1 and 2, providing a spring biasing force urging the seat upwardly. When the occupant is now seated, the seat is continually provided with a force urging it upwardly against the seat of the occupant. When the occupant now arises from the chair, the spring-biased force assists him in rising. As many springs as needed may be mounted between the hooks when the apparatus is in the disengaged condition, dependent on the weight of the occupant and the force required to assist him. Additionally, although the springs should all be of the same length, springs of different strengths may be utilized, also dependent upon the needs of the particular occupant and may be purchased in the market color-coded for strength. When the chair is not in use, the hand grip 44 may be grasped and the hook 45 disengaged from the detent 46, thereby removing springbiasing force from the seat lifting apparatus and permitting the seat 23 to assume the collapsed condition. This is done both for the sake of safety and to permit the chair to be used as a conventional chair.

The chair of the invention has a number of advantages over chairs disclosed in the prior art for the same purpose. The chair is relatively small and light since no power operated devices such as motors, gears, or pistons are required for its operation. The chair may be fabricated from relatively inexpensive parts which are readily available in the market. The chair operates very simply and very effectively in assisting the occupant to arise from the chair. When it is desired to utilize the chair as a conventional chair, the spring actuating apparatus is disengaged by removing the hook 45 from the -engaging detent 46, causing the seat to drop down to a flat position.

Although the invention has been described in connection with only specific embodiments thereof, it is evident that many alternatives, modifications, and variations will be apparent to those skilled in the art in the light of the foregoing description and drawing. Accordingly, it is intended to embrace all such alternatives, modifications and variations within the spirit and scope of the appended claims.

Invention is claimed as follows:

1. A chair having lifting means for assisting a physically impaired occupant to arise out of the chair, comprising:

a detent mounted on said chair, a frame, a seat hingedly mounted at its forward edge to said frame, seat lifting means pivotally attached to said frame and to said seat, spring biasing actuating means pivotally attached to said frame, one or more springs connected between said seat lifting means and said spring biasing actuating means, and lever means pivotally mounted on said spring biasing actuating means having hook means adapted to engage the detent means of said frame, whereby, when said lever means is raised and said hook engaged in said detent of said frame, said springs are stretched, thereby applying a spring biasing force urging said seat upwardly, and whereby when said hook means is disengaged from said detent, said seat is permitted to collapse to the inoperative condition.

2. A chair according to claim 1, wherein said spring biasing actuating means comprises a pair of lever means pivotally mounted on said frame, a transverse member connecting said lever means having a plurality of hooks thereon for engaging one end of said springs, and a second transverse member having said lever means pivotally connected thereto.

3. A chair according to claim 1, wherein said seat lifting means comprises a pair of lever members pivotally connected to said seat, a second pair of lever members having one end connected to said first lever members and the other end connected to said frame, and a transverse member connected to said lever members having hooks mounted thereon connected to an end of each of said springs.

4. A chair according to claim 1, wherein said lever means utilized in moving said spring biasing actuating means is provided with a hand grip.

5. A chair according to claim 2, wherein said seat lifting means comprises a pair of lever members pivotally connected to said seat, a second pair of lever members having one end pivotally connected to said first lever members and the other end connected to said frame, and a transverse member connected to said lever members having hooks mounted thereon connected to one end of each of said springs.

* * * * *